US010903028B2

(12) United States Patent
Cai et al.

(10) Patent No.: US 10,903,028 B2
(45) Date of Patent: Jan. 26, 2021

(54) ROTARY SWITCH STRUCTURE

(71) Applicant: Primax Electronics Ltd., Taipei (TW)

(72) Inventors: Liu-Bing Cai, Taipei (TW); Li-Xiong Deng, Taipei (TW); Li-Qiang Chen, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 0 days.

(21) Appl. No.: 16/449,782

(22) Filed: Jun. 24, 2019

(65) Prior Publication Data

US 2020/0312589 A1 Oct. 1, 2020

(30) Foreign Application Priority Data

Mar. 29, 2019 (CN) ..... 2019 1 0250969

(51) Int. Cl.
*H01H 19/04* (2006.01)
*H01H 19/08* (2006.01)
*H01H 19/14* (2006.01)

(52) U.S. Cl.
CPC ..... *H01H 19/04* (2013.01); *H01H 19/08* (2013.01); *H01H 19/14* (2013.01)

(58) Field of Classification Search
CPC ..... H01H 19/04; H01H 19/08; H01H 19/14; H01H 19/001; H01H 19/11; H01H 2019/146; H01H 19/20; H01H 19/54; H01H 19/60; H01H 19/62; H01H 3/08; H01H 3/10
USPC ..... 200/336, 564, 565, 11 R–11 TW, 316, 200/566–572, 8 R, 8 A, 9; 345/184; 74/10.41, 527; 341/35
See application file for complete search history.

(56) References Cited

U.S. PATENT DOCUMENTS

| | | | | |
|---|---|---|---|---|
| 6,225,580 | B1 * | 5/2001 | Lemire | H01H 1/16 200/11 D |
| 6,797,907 | B1 * | 9/2004 | Meagher | H01H 19/585 200/18 |
| 7,414,205 | B1 * | 8/2008 | Heinrich | H01H 19/63 200/336 |
| 8,710,384 | B2 * | 4/2014 | Son | B60Q 1/00 200/61.27 |
| 2019/0155324 | A1 * | 5/2019 | Wang | G05G 5/005 |

* cited by examiner

*Primary Examiner* — Edwin A. Leon
*Assistant Examiner* — Lheiren Mae A Caroc
(74) *Attorney, Agent, or Firm* — Kirton McConkie; Evan R. Witt

(57) ABSTRACT

A rotary switch structure includes a sleeve, a seat body, an elastic ring, plural push elements and a fixing element. The seat body is accommodated within the sleeve. The elastic ring is disposed on the seat body. The plural push elements are disposed on the elastic ring, and provide a pushing force to the elastic ring. The fixing element is fixed in the sleeve and contacted with the plural push elements. The plural push elements are fixed on the elastic ring by the fixing element. The elastic ring absorbs the pushing force, so that a friction force between the at least one push element and the elastic ring is adjustable. Consequently, the rotating feel of the rotary switch structure is adjustable according to the practical requirements.

9 Claims, 5 Drawing Sheets

ROTARY SWITCH STRUCTURE

FIELD OF THE INVENTION

The present invention relates to a rotary switch structure, and more particularly to a rotary switch structure for a professional computer host.

BACKGROUND OF THE INVENTION

With increasing development of science and technology, computer hosts are popular to the general users. In some situations, each user has plural computer hosts. Generally, the computer host and a computer peripheral device are collaboratively formed as a computer system. The computer system can be operated by the user. The computer peripheral device includes a display screen, a keyboard and/or a mouse. When an application software is executed, various tasks can be implemented. For example, these tasks include a word processing task, a programming language, an industrial drawing task, a design drawing task, and so on.

However, when the professional worker operates the computer system to perform the drawing task, the professional worker has to use a mouse and a keyboard to implement the drawing task. Since the way of operating the mouse and the keyboard is very different from the handwriting operation, the professional worker cannot implement the drawing task in the handwriting manner through the computer system. For meeting the requirements of the professional worker, a handwriting tablet and a touch pen for the handwriting tablet have been introduced into the market. The user can implement the drawing task in the handwriting manner through the handwriting tablet and the touch pen. For implementing the conventional handwriting task, a paper is placed on a desk surface or a work platform and the picture is drawn on the paper. However, while the handwriting tablet and the touch pen are used to perform the writing task, the professional worker has to watch the display screen. In other words, the writing task using the handwriting tablet and the touch pen is different from the conventional handwriting task.

Recently, a computer system with a professional computer host is introduced into the market. A display screen of the computer system is connected with the computer host. According to the practical requirements, the display screen is rotatable. Similarly, the user can operate the computer system through the uses of the keyboard, the mouse and the touch pen. The display screen is a touch screen. Consequently, the professional worker can directly draw on the display screen. Especially, the display screen is rotatable relative to the professional computer host through a special rotary switch structure. The rotating angle of the display screen is controlled through the rotary switch structure. As the rotating angle of the display screen is adjusted and the display screen is in a lie-flat state, the display screen is similar to the work platform that is drawn by the professional work in the handwriting manner. For allowing the professional work to rotate the display screen at the desired angle, the rotary switch structure needs to provide precise rotating stages.

Therefore, there is a need of providing a rotary switch structure having a precise rotating function so as to meet the user's requirement.

SUMMARY OF THE INVENTION

The present invention provides a rotary switch structure having a precise rotating function.

In accordance with an aspect of the present invention, a rotary switch structure is provided. The rotary switch structure includes a sleeve, a seat body, an elastic ring, at least one push element and a fixing element. When an external force is applied to the sleeve, the sleeve is rotated. The seat body is accommodated within the sleeve. The elastic ring is disposed on the seat body. The at least one push element is disposed on the elastic ring, and provides a pushing force to the elastic ring. The fixing element is fixed in the sleeve and contacted with the at least one push element. The at least one push element is fixed on the elastic ring by the fixing element. The elastic ring absorbs the pushing force, so that a friction force between the at least one push element and the elastic ring is adjustable.

In accordance with another aspect of the present invention, a rotary switch structure is provided. The rotary switch structure includes a sleeve, a seat body, an elastic ring, at least one push element and a fixing element. When an external force is applied to the sleeve, the sleeve is rotated. The seat body is accommodated within the sleeve. The elastic ring is disposed on the seat body. The at least one push element is disposed on the elastic ring, and provides a pushing force to the elastic ring. The fixing element is fixed in the sleeve and contacted with the at least one push element. The at least one push element is fixed on the elastic ring by the fixing element. The fixing element includes a ring-shaped plate and at least one position-limiting part. The ring-shaped plate is fixed in the sleeve, and located over the elastic ring. The at least one position-limiting part is disposed on a bottom surface of the ring-shaped plate and aligned with the at least one push element. The at least one position-limiting part is contacted with the corresponding push element to limit a position of the corresponding push element, so that the at least one push element is fixed on the elastic ring.

From the above descriptions, the present invention provides the rotary switch structure. The plural push elements are continuously contacted with the elastic ring. Consequently, a friction force between the plural push elements and the elastic ring is generated, and the rotating feel of the rotary switch structure is adjustable. Moreover, the positions of the push elements are limited by the fixing element, and the push elements are continuously pushed by the fixing element. Consequently, the push elements continuously provide the pushing force to the elastic ring. Moreover, the arrangement of the concave structure of the elastic ring can control the minimum rotating force to rotate the rotary switch structure. In such way, the rotating feel of the rotary switch structure is adjustable.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
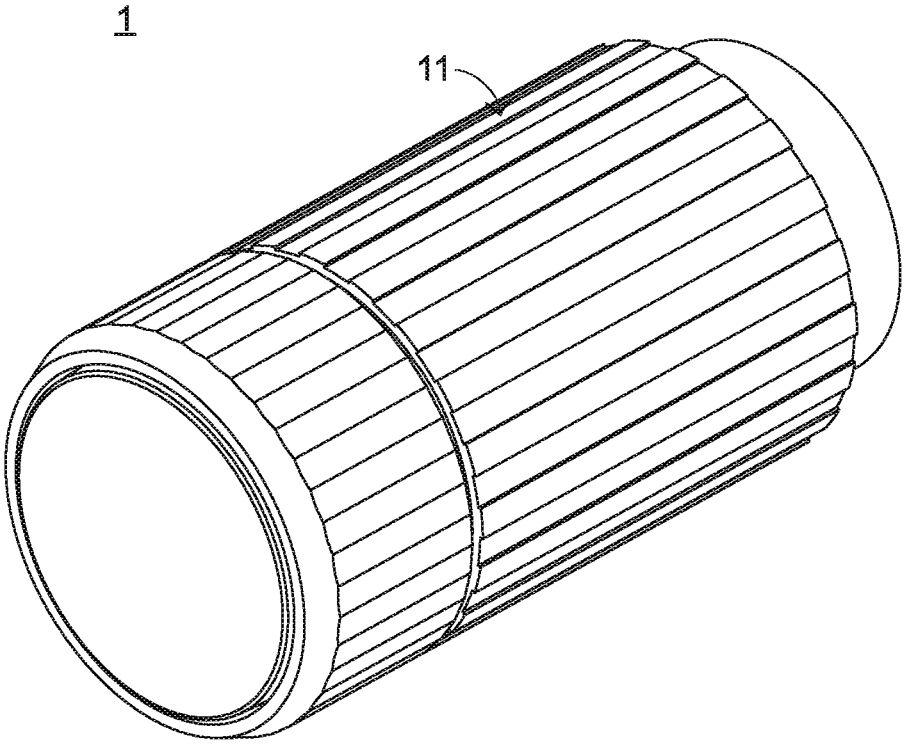
FIG. 1 is a schematic perspective view illustrating the appearance of a rotary switch structure according to an embodiment of the present invention.

For solving the drawbacks of the conventional technologies, the present invention provides a rotary switch structure. The embodiments of present invention will be described more specifically with reference to the following drawings. For well understanding the present invention, the elements shown in the drawings are not in scale with the elements of the practical product. In the following embodiments and drawings, the elements irrelevant to the concepts of the present invention or the elements well known to those skilled in the art are omitted. It is noted that numerous modifications and alterations may be made while retaining the teachings of the invention.

Figure 2:
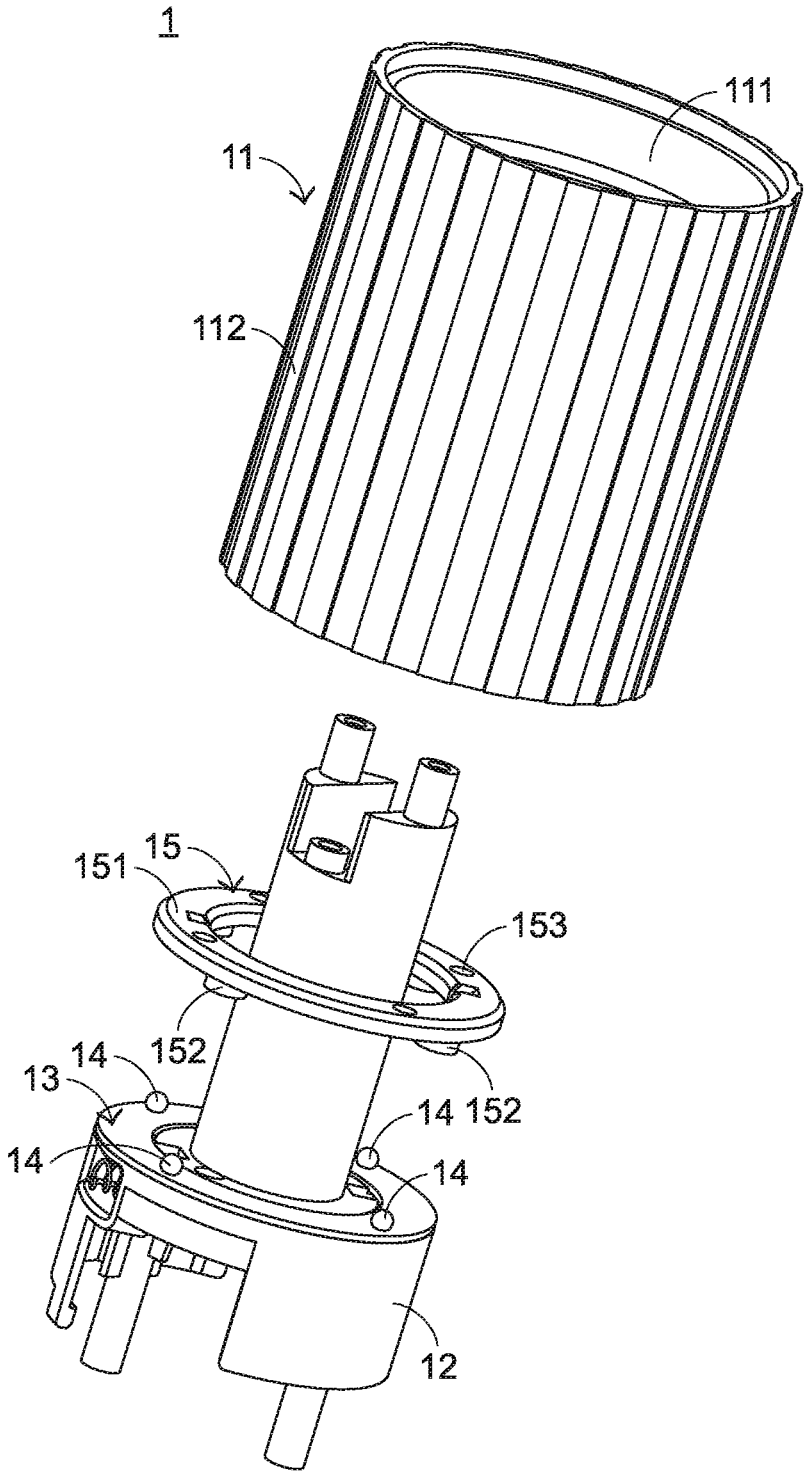
FIG. 2 is a schematic explodes view illustrating a portion of the rotary switch structure according to the embodiment of the present invention.
Figure 3:
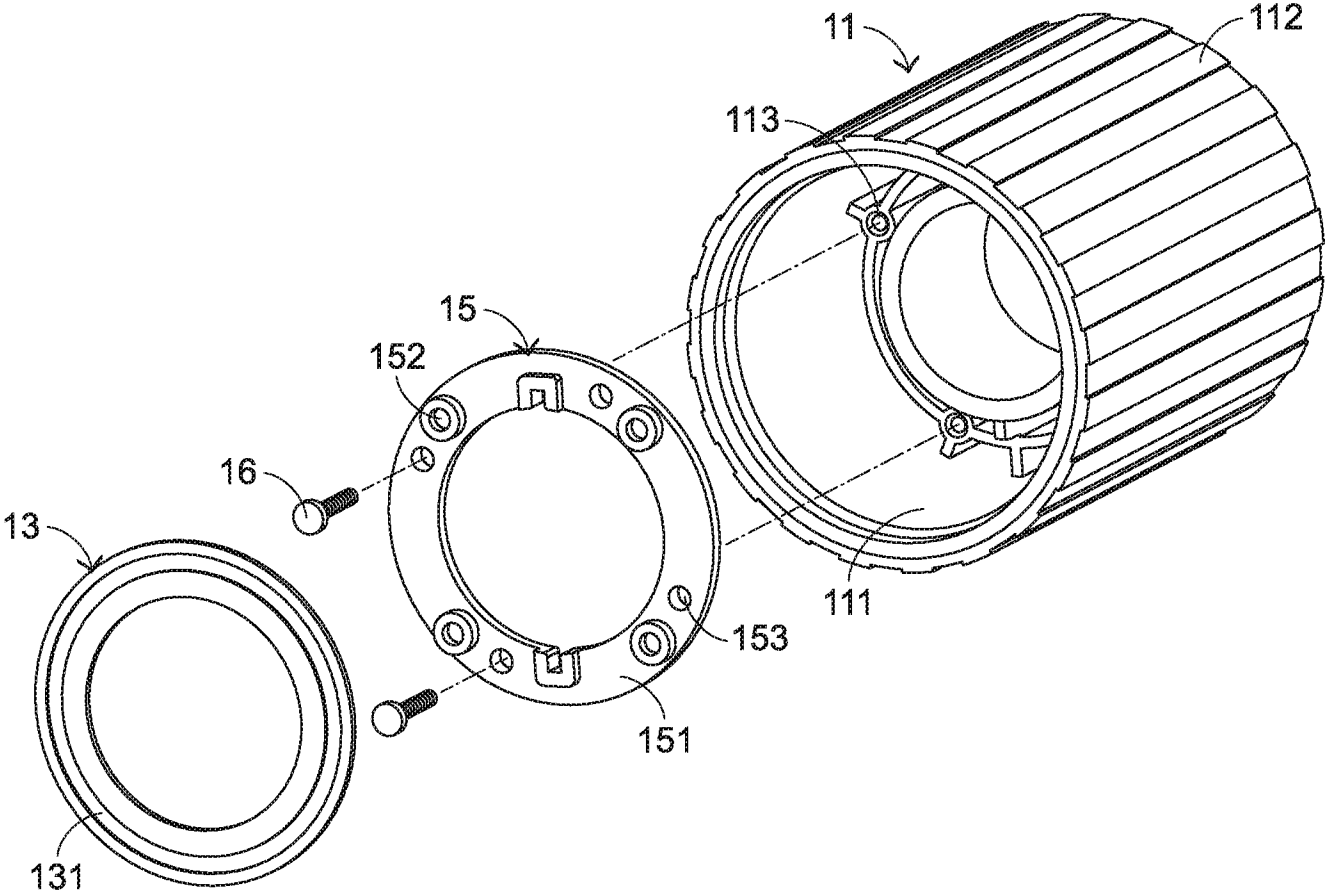
FIG. 3 is a schematic explodes view illustrating a portion of the rotary switch structure according to the embodiment of the present invention and taken along another viewpoint.

Please refer to FIGS. 1, 2 and 3. FIG. 1 is a schematic perspective view illustrating the appearance of a rotary switch structure according to an embodiment of the present invention. FIG. 2 is a schematic explodes view illustrating a portion of the rotary switch structure according to the embodiment of the present invention. FIG. 3 is a schematic explodes view illustrating a portion of the rotary switch structure according to the embodiment of the present invention and taken along another viewpoint.

The rotary switch structure 1 is inserted into a professional computer host (not shown). The rotary switch structure 1 comprises a sleeve 11, a seat body 12, an elastic ring 13, plural push elements 14 and a fixing element 15. When an external force is applied to the sleeve 11, the sleeve 11 is rotatable. The sleeve 11 comprises a main body 111, a contacting cover 112 and plural coupling parts 113. The plural coupling parts 113 are disposed within the main body 111. The contacting cover 112 is sheathed around the main body 111 to receive the external force. Consequently, the main body 111 is rotated with the contacting cover 112. Moreover, for facilitating the user to contact and rotate the contacting cover 112, the outer surface of the contacting cover 112 is a lumpy surface.

The seat body 12 is accommodated within the sleeve 11. The plural push elements 14 are disposed on the elastic ring 13 to provide a pushing force to the elastic ring 13. The elastic ring 13 is disposed on the seat body 12. The elastic ring 13 is used for absorbing the pushing force from the plural push elements 14 and adjusting the friction force between the plural push elements 14 and the elastic ring 13. Consequently, the feel of rotating the rotary switch structure 1 can be correspondingly adjusted. The elastic ring 13 has a concave structure 131. The concave structure 131 is formed in a bottom surface of the elastic ring 13. Moreover, the concave structure 131 is located under a contact region between the plural push elements 14 and the elastic ring 13. In an embodiment, the push elements 14 are metal balls, the elastic ring 13 is made of rubbery material, and the concave structure 131 is a ring-shaped groove. It is noted that the type of the push elements, the material of the elastic ring and the shape of the concave structure are not restricted.

Figure 4:
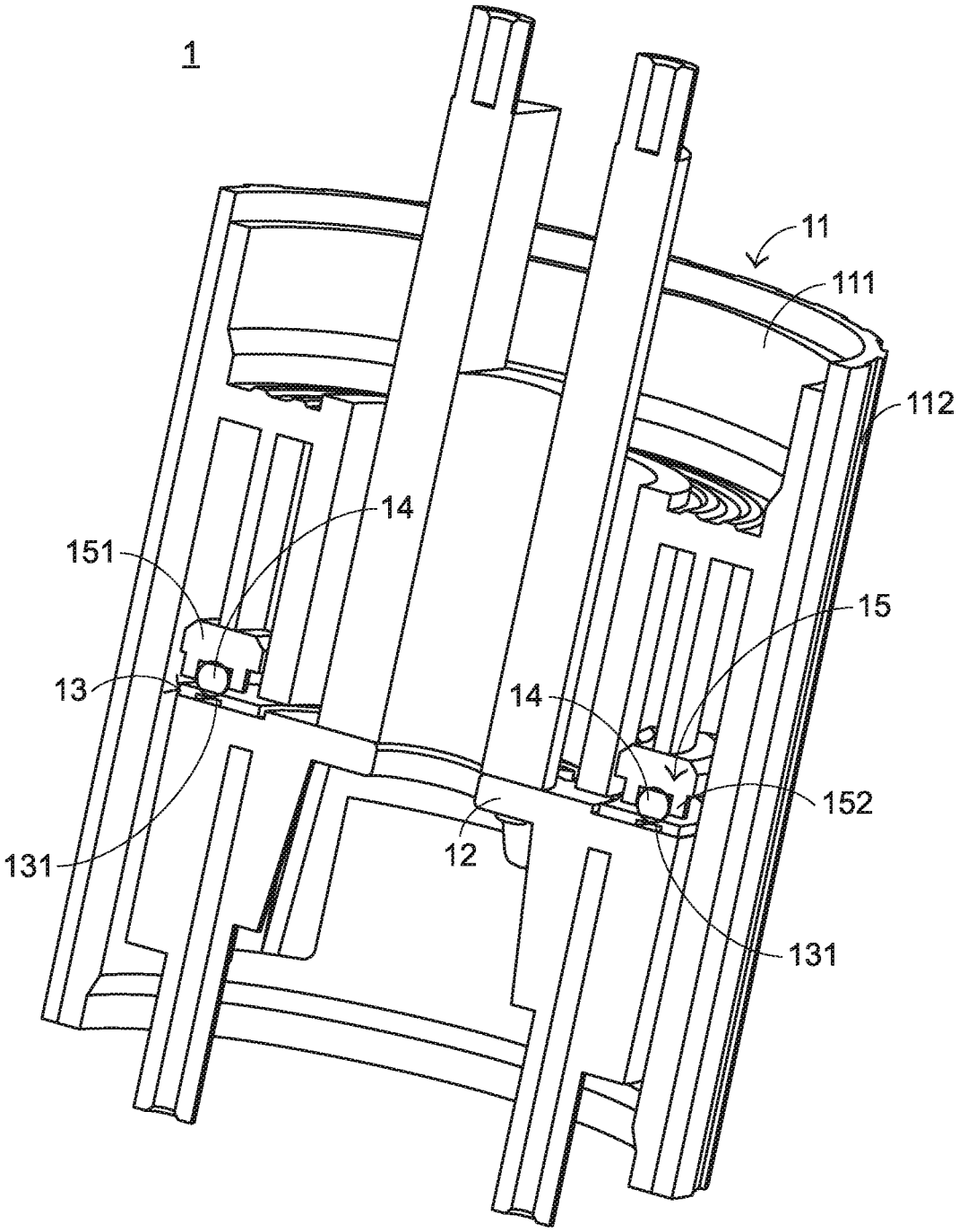
FIG. 4 is a schematic cutaway view illustrating a portion of the rotary switch structure according to the embodiment of the present invention.

FIG. 4 is a schematic cutaway view illustrating a portion of the rotary switch structure according to the embodiment of the present invention. Please refer to FIGS. 2, 3 and 4. The fixing element 15 is fixed in the sleeve 11 and contacted with the plural push elements 14. The fixing element 15 is used for fixing the plural push elements 14 on the elastic ring 13. In an embodiment, the fixing element 15 comprises a ring-shaped plate 151, plural position-limiting parts 152 and plural openings 153. The ring-shaped plate 151 is fixed in the sleeve 11 and located over the elastic ring 13. The plural position-limiting parts 152 are disposed on a bottom surface of the ring-shaped plate 151 and aligned with the respective push elements 14. The plural position-limiting parts 152 are contacted with the corresponding push elements 14, respectively. Moreover, since the positions of the push elements 14 are limited by the corresponding position-limiting parts 152, the plural push elements 14 are fixed on the elastic ring 13. The plural openings 153 are formed in the ring-shaped plate 151. The plural openings 153 are aligned with the corresponding coupling parts 113 of the sleeve 11, respectively. After plural fastening elements 16 are penetrated through the corresponding openings 153 and tightened into the corresponding coupling parts 113, the fixing element 15 is fixed in the sleeve 11. In this embodiment, the fastening elements 16 are screws, and the fixing element 15 is fixed in the sleeve 11 through a screwing means. It it noted that numerous modifications may be made while retaining the teachings of the present invention. For example, the fastening element 16 is any other appropriate element with the coupling function.

Figure 5:
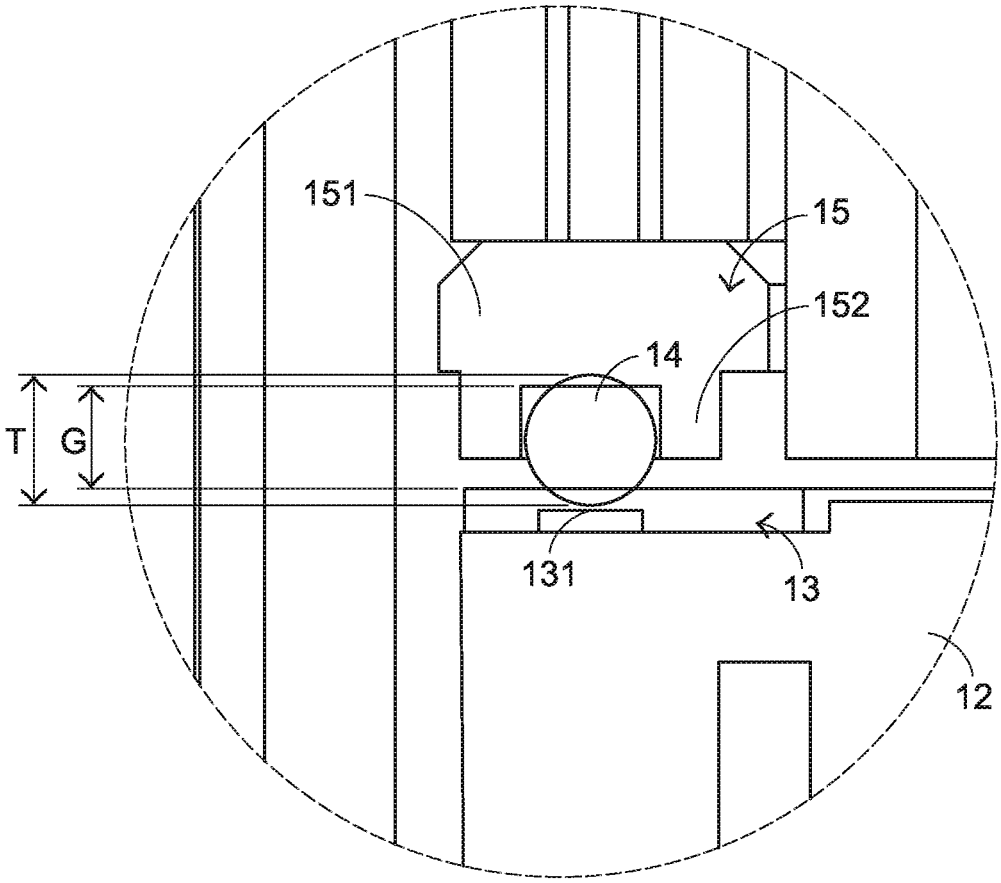
FIG. 5 is a schematic cross-sectional view illustrating a portion of the rotary switch structure according to the embodiment of the present invention, in which the elastic ring is pushed by the push element.

FIG. 5 is a schematic cross-sectional view illustrating a portion of the rotary switch structure according to the embodiment of the present invention, in which the elastic ring is pushed by the push element. Please refer to FIGS. 4 and 5. In FIG. 4, the connecting relationships between the components of the rotary switch structure are shown. The elastic ring 13 is disposed on the seat body 12. The plural push elements 14 are disposed on the elastic ring 13 to push the elastic ring 13. The position-limiting parts 152 of the fixing element 15 are sheathed around the corresponding push elements 14 to limit the positions of the push elements 14. Consequently, the plural push elements 14 are continuously contacted with the elastic ring 13. As shown in FIGS. 4 and 5, the gap G between each position-limiting part 152 and the elastic ring 13 is smaller than the thickness T of the corresponding push element 14. Since the push elements 14 are pushed downwardly by the corresponding position-limiting parts 152, the elastic ring 13 is continuously pushed by the push elements 14. In response to the pushing force, the elastic ring 13 is subjected to deformation. For clearly showing that the gap G between each position-limiting part 152 and the elastic ring 13 is smaller than the thickness T of the corresponding push element 14, the deformation of the elastic ring 13 is not shown in FIGS. 4 and 5.

The operations of the rotary switch structure 1 will be described as follows. Please refer to FIGS. 2 and 4. When the user does not apply the external force to the sleeve 11, the elastic ring 13 is continuously pushed by the push elements 14 because of the above designed structure. In addition, the elastic ring 13 is subjected to the deformation in response to the pushing force. When the contacting cover 112 receives the external force from the user, the main body 111 is correspondingly rotated with the contacting cover 112 and relative to the seat body 12. Since the fixing element 15 is coupled with the main body 111, the fixing element 15 is rotated with the main body 111. Moreover, the plural push elements 14 are in the pushing state and moved relative to the elastic ring 13. That is, while the elastic ring 13 is continuously pushed by the push elements 14, the push elements 14 are moved on the elastic ring 13.

Preferably, the rotating feel of the rotary switch structure is not too heavy or too light. In this context, the rotating feel of the rotary switch structure indicates the minimum rotating force for the user to rotate the rotary switch structure. If the external force applied by the user is higher than or equal to the minimum rotating force, the sleeve 11 is forced to rotate. For providing the moderate rotating feel of the rotary switch structure, the mechanism of the rotary switch structure with the elastic ring 13, the plural push elements 14 and the fixing element 15 is operated to adjust the rotating feel of the rotary switch structure. The key factor of providing the moderate rotating feel of the rotary switch structure is the friction force between the plural push elements 14 and the elastic ring 13.

As mentioned above, the concave structure 131 is formed in the bottom surface of the elastic ring 13. After the undue experiments, the structure of the elastic ring 13 is specially designed. Generally, the depth of the concave structure 131 is positively related to the thickness of the elastic ring 13. As the depth of the concave structure 131 is increased, the magnitude of the pushing force to the absorbed by the elastic ring 13 is increased. Consequently, the change of the depth of the concave structure 131 can control the minimum rotating force to rotate the rotary switch structure. In such way, the rotating feel of the rotary switch structure is adjusted to the moderate level. In other words, the rotating feel of the rotary switch structure 1 of the present invention is adjustable according to the practical requirements. Moreover, since the concave structure 131 is formed in the bottom surface of the elastic ring 13, the production tolerance of the elastic ring 13 is slightly increased. Since the precision of fabricating the elastic ring 13 is not very high, the fabricating cost is reduced.

From the above descriptions, the present invention provides the rotary switch structure. The plural push elements are continuously contacted with the elastic ring. Consequently, a friction force between the plural push elements and the elastic ring is generated, and the rotating feel of the rotary switch structure is adjustable. Moreover, the positions of the push elements are limited by the fixing element, and the push elements are continuously pushed by the fixing element. Consequently, the push elements continuously provide the pushing force to the elastic ring. Moreover, the arrangement of the concave structure of the elastic ring can control the minimum rotating force to rotate the rotary switch structure. In such way, the rotating feel of the rotary switch structure is adjustable.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all modifications and similar structures.

What is claimed is:

1. A rotary switch structure, comprising:

a sleeve, wherein when an external force is applied to the sleeve, the sleeve is rotated;

a seat body accommodated within the sleeve;

an elastic ring disposed on the seat body;

at least one push element disposed on the elastic ring, and providing a pushing force to the elastic ring; and a fixing element fixed in the sleeve and contacted with the at least one push element, wherein the at least one push element is fixed on the elastic ring by the fixing element, wherein the fixing element comprises:

a ring-shaped plate fixed in the sleeve, and located over the elastic ring; and at least one position-limiting part disposed on a bottom surface of the ring-shaped plate and aligned with the at least one push element, wherein the at least one position-limiting part is contacted with the at least one push element to limit a position of the at least one push element, so that the at least one push element is fixed on the elastic ring, wherein the elastic ring absorbs the pushing force, so that a friction force between the at least one push element and the elastic ring is adjustable.

2. The rotary switch structure according to claim 1, wherein the elastic ring has a concave structure, wherein the concave structure is formed in a bottom surface of the elastic ring, and the concave structure is located under a contact region between the at least one push element and the elastic ring.

3. The rotary switch structure according to claim 2, wherein as a depth of the concave structure is increased, a magnitude of the pushing force to be absorbed by the elastic ring is increased.

4. The rotary switch structure according to claim 1, wherein the fixing element further comprises plural openings, and the plural openings are formed in the ring-shaped plate, wherein the sleeve comprises plural coupling parts corresponding to the plural openings, respectively, wherein after plural fastening elements are penetrated through the plural openings and tightened into the corresponding coupling parts, the fixing element is fixed in the sleeve.

5. The rotary switch structure according to claim 4, wherein the sleeve comprises:

a main body, wherein the plural coupling parts are disposed within the main body; and a contacting cover, wherein the contacting cover is sheathed around the main body to receive the external force, and the main body is rotatable with the contacting cover, wherein when the contacting cover receives the external force, the main body is correspondingly rotated with the contacting cover and relative to the seat body, so that the at least one push element is in a pushing state and moved relative to the elastic ring.

6. A rotary switch structure, comprising:

a sleeve, wherein when an external force is applied to the sleeve, the sleeve is rotated;

a seat body accommodated within the sleeve;

an elastic ring disposed on the seat body;

at least one push element disposed on the elastic ring, and providing a pushing force to the elastic ring; and a fixing element fixed in the sleeve and contacted with the at least one push element, wherein the at least one push element is fixed on the elastic ring by the fixing element, wherein the fixing element comprise:

a ring-shaped plate fixed in the sleeve, and located over the elastic ring; and at least one position-limiting part disposed on a bottom surface of the ring-shaped plate and aligned with the at least one push element, wherein the at least one position-limiting part is contacted with the at least one push element to limit a position of the at least one push element, so that the at least one push element is fixed on the elastic ring.

7. The rotary switch structure according to claim 6, wherein the elastic ring has a concave structure, wherein the concave structure is formed in a bottom surface of the elastic ring, and the concave structure is located under a contact region between the at least one push element and the elastic ring, wherein the elastic ring absorbs the pushing force, so that a friction force between the at least one push element and the elastic ring is adjustable.

8. The rotary switch structure according to claim 6, wherein the fixing element further comprises plural openings, and the plural openings are formed in the ring-shaped plate, wherein the sleeve comprises plural coupling parts corresponding to the plural openings, respectively, wherein after plural fastening elements are penetrated through the plural openings and tightened into the corresponding coupling parts, the fixing element is fixed in the sleeve.

9. The rotary switch structure according to claim 8, wherein the sleeve comprises:

a main body, wherein the plural coupling parts are disposed within the main body; and a contacting cover, wherein the contacting cover is sheathed around the main body to receive the external force, and the main body is rotatable with the contacting cover, wherein when the contacting cover receives the external force, the main body is correspondingly rotated with the contacting cover and relative to the seat body, so that the at least one push element is in a pushing state and moved relative to the elastic ring.

* * * * *